US012071278B2

(12) United States Patent
Fogueteiro

(10) Patent No.: US 12,071,278 B2
(45) Date of Patent: Aug. 27, 2024

(54) JAR FOR COSMETIC PRODUCT HAVING A NON-CYLINDRICAL NECK

(71) Applicant: CHANEL PARFUMS BEAUTE, Neuilly-sur-Seine (FR)

(72) Inventor: Paulo Fogueteiro, Neuilly sur Seine (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 93 days.

(21) Appl. No.: 17/801,112

(22) PCT Filed: Feb. 17, 2021

(86) PCT No.: PCT/FR2021/050277
§ 371 (c)(1),
(2) Date: Aug. 19, 2022

(87) PCT Pub. No.: WO2021/165613
PCT Pub. Date: Aug. 26, 2021

(65) Prior Publication Data

US 2023/0083010 A1 Mar. 16, 2023

(30) Foreign Application Priority Data

Feb. 21, 2020 (FR) ..... 2001734

(51) Int. Cl.
*B65D 41/04* (2006.01)
*A45D 33/00* (2006.01)
(Continued)

(52) U.S. Cl.
CPC ..... *B65D 41/0471* (2013.01); *A45D 33/006* (2013.01); *A45D 40/0068* (2013.01);
(Continued)

(58) Field of Classification Search
CPC ..... B65D 41/0471; B65D 2251/065; B65D 2251/07; A45D 33/006; A45D 40/0068; A45D 2034/002
See application file for complete search history.

(56) References Cited

U.S. PATENT DOCUMENTS 3,376,991 A * 4/1968 Deaver ..... B65D 50/046 215/217
4,333,580 A * 6/1982 Sweigart, Jr. ..... E04H 5/04 220/4.07
(Continued)

FOREIGN PATENT DOCUMENTS

FR 1551009 12/1968
FR 2632931 A1 12/1989
(Continued)

OTHER PUBLICATIONS

International Search Report issued in International Patent Application No. PCT/FR2021/050277, dated Jun. 7, 2021, along with an English translation thereof.
(Continued)

*Primary Examiner* — James N Smalley
(74) *Attorney, Agent, or Firm* — GREENBLUM & BERNSTEIN, P.L.C.

(57) ABSTRACT

A jar for cosmetic products that includes a base surmounted by a neck and a lid, the neck having a non-circular cross-section and including a rim. The neck includes at least one first assembly element, the lid including at least one second assembly element. The lid is configured so that: (1) when the lid is in a closed position: (1a) the at least one second assembly element is arranged under the rim; and (1b) the at least one second assembly element and the at least one first assembly element are nested together, and (2) when the lid is in an open position, the at least one second assembly element is disengaged from the at least one first assembly
(Continued)

element and the rim. The lid is configured to pass from one position to the other by rotation about the neck.

16 Claims, 4 Drawing Sheets

(51) Int. Cl.
*A45D 34/00* (2006.01)
*A45D 40/00* (2006.01)

(52) U.S. Cl.
CPC .. *A45D 2034/002* (2013.01); *B65D 2251/065* (2013.01); *B65D 2251/07* (2013.01)

(56) References Cited

U.S. PATENT DOCUMENTS 4,662,530 A 5/1987 Concalves et al.
4,723,686 A * 2/1988 Pennisi ..... B65F 1/1615 220/908
5,160,057 A * 11/1992 Fitjer ..... B65D 41/0471 215/331
6,318,578 B1 11/2001 Patterson et al.
7,959,022 B2 6/2011 Cebal
10,159,628 B2 * 12/2018 Edgerley ..... A61J 9/00
11,794,938 B2 * 10/2023 Yourist ..... B65D 43/0212
2017/0127797 A1 5/2017 Salciarini et al.

FOREIGN PATENT DOCUMENTS

JP S4943370 U 4/1974
JP H1159708 A 3/1999

OTHER PUBLICATIONS

Written Opinion of the International Searching Authority issued in International Patent Application No. PCT/FR2021/050277, dated Jun. 7, 2021.
Notification of First Office Action of China Application No. 202180015625.3, from China National Intellectual Property Administration, dated Jun. 6, 2024, in English language.
Office Action from the Japanese Patent Office for Patent Application No. 2022-549864, dated May 21, 2024, in English language.

* cited by examiner

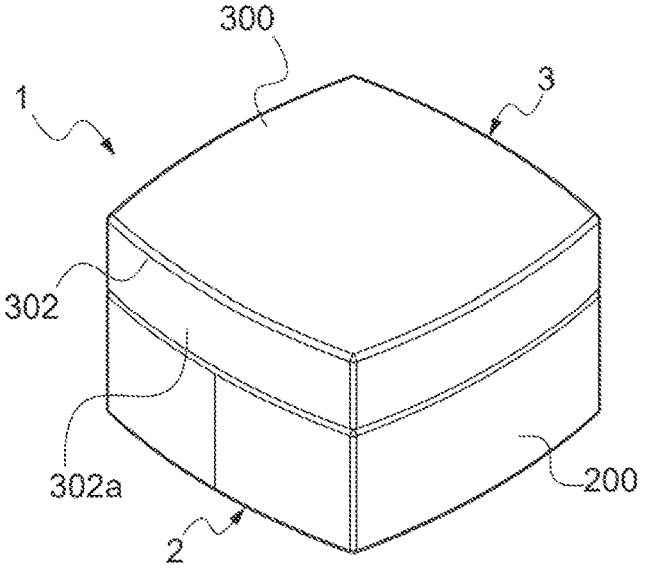
Fig.1
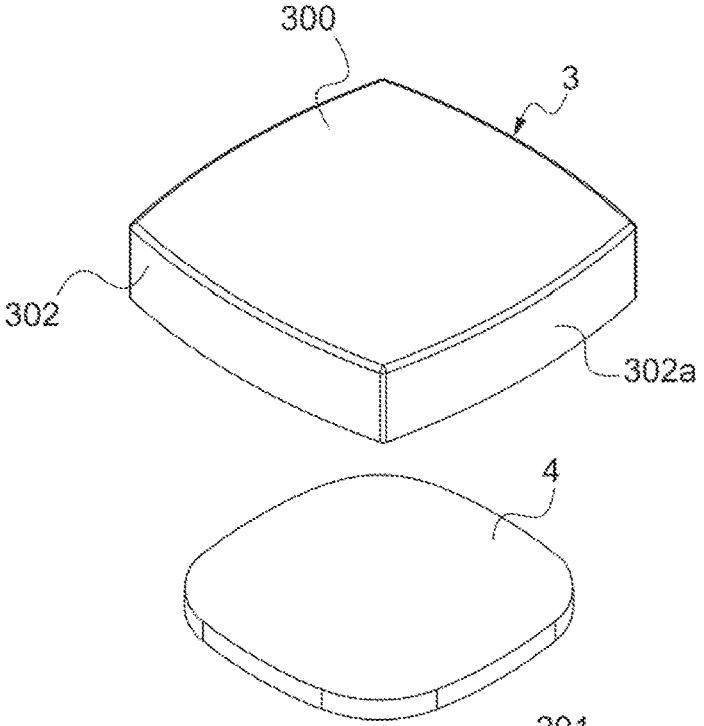
Fig.2
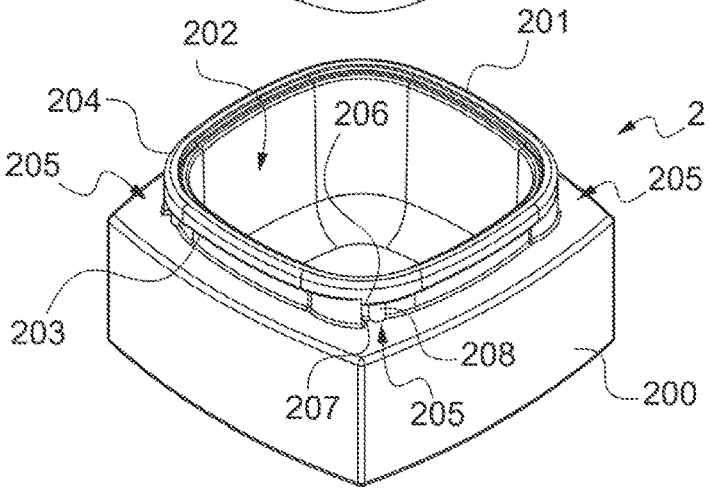

JAR FOR COSMETIC PRODUCT HAVING A NON-CYLINDRICAL NECK

BACKGROUND

1. Field of the Invention

The present invention concerns the field of pots, in particular that of pots for cosmetic products. By cosmetic product is meant in particular all products for making up the skin, including the lips, and all compositions provided for application to the body, including what are referred to as care products such as moisturizing creams, cleansing products or products directed to protecting the skin from the sun.

2. Description of the Background

Pots for cosmetic products generally comprise a base, forming a reservoir configured to contain a cosmetic product, surmounted by a neck defining an opening. The base is closed by a lid.

In known manner, the neck is substantially cylindrical. In other words, the cross-section of the neck is circular or the opening defined by the neck is circular. The cylindrical shape of the neck enables simple closing and opening of the pot, in particular by screwing and unscrewing the lid on and from the base. To that end, the neck is generally provided with a screw thread or with a screw ramp.

However, it may be desirable to manufacture a neck of different shape. In this connection, pots are known having a neck of non-circular cross-section, in particular having a square cross-section defining a square opening. In order to enable the closing and opening of such a pot, some solutions of the prior art provide a hinge system linking the base to the lid. Other alternative closing and opening systems exist, such as that described in document FR 1551009, consisting of adding mechanisms that are complex and difficult to implement.

The existing solutions for non-cylindrical necks thus have the drawback of being complex and/or requiring the usual form of manipulation for closing and opening by rotating the lid on the base of the pot.

SUMMARY

The present invention is directed to solving at least one of the aforesaid drawbacks. In particular, the invention is directed to providing a pot for cosmetic products having a non-cylindrical neck and enabling easy opening and closing while maintaining a simple and natural form of manipulation.

The invention concerns a cosmetic product pot comprising a base surmounted by a neck defining an opening and a lid configured to close said opening, said neck having a non-circular cross-section, said neck comprising a rim forming a bead over the perimeter of the neck.

According to the invention, the neck comprises at least one first assembly member formed in an outside wall surface of the neck under they rim, the lid comprising a contour wall surface configured to surround the neck when the lid is positioned on the neck in an opening position or a closing position in which positions the lid closes the opening, the lid comprising at least one second assembly member formed in the contour wall surface and of complementary shape to said at least one first assembly member, so as to enable fitting together of said at least one first assembly member with the at least one second assembly member through insertion; the lid being configured such that:

when the lid is in the closing position:

said at least one second assembly member of the lid is disposed under the rim of the neck, preventing a vertical extraction of the lid relative to the neck; and said at least one second assembly member and said at least one first assembly member are fitted together by insertion so as to create resistance to relative rotation of the lid and the neck, and when the lid is in the opening position said at least one second assembly member is clear of said at least one first assembly member and of the rim of the neck, so as to enable the vertical extraction of the lid relative to the neck, the lid being configured to pass from the opening position to the closing position and vice-versa by rotation of the lid around the neck.

Such a pot having a non-cylindrical neck enables the same opening and closing movement to be performed as with a conventional pot have a cylindrical neck and of which the lid is screwed onto the base, that is to say for example with rotation in the anticlockwise direction to open the pot and in the clockwise direction to close it.

Moreover, stopping the rotation by fitting together of the first assembly member and the second assembly member through insertion enables the user to know when the lid is properly closed or tightened on the base. This makes it possible to avoid excessive tightening which may end up leading to wear of the pot, and in particular crushing of a seal disposed between the lid and the base. This also makes it possible to avoid insufficient tightening of the lid on the pot, thereby ensuring proper seating of the pot.

According to a feature, the contour wall surface of the lid delimits a cavity provided in the lid the cross-section of which corresponds to the superposition of the cross-section of the neck in a first position and of the cross-section of the neck in a second position rotated through a predefined angle relative to the first position.

The lid thus comprises a cavity dimensioned so as to be able to closely fit the form of the neck.

According to a feature, the predefined angle is less than 45° and strictly greater than 0°, and is preferably equal to 22°.

According to a feature, the neck has a prismatic cross-section having a base of polygonal shape or of polygonal shape having rounded corners and/or sides.

According to a feature, the neck has a square cross-section, or a square cross-section with rounded corners and/or sides.

According to a feature, said at least one first assembly member is formed at the location of one or more corners of the cross-section of the neck.

This facilitates identifying the location of said at least one first assembly member for the closing and the opening of the pot.

According to a feature, the neck comprises a number of first assembly members equal to the number of sides of said polygon.

According to a feature, the neck has an oval cross-section.

According to a feature, the lid comprises a number of second assembly members equal to the number of first assembly members of the neck.

According to a feature, said at least one first assembly member comprises a projection in relief of the outside wall surface of the neck and said at least one second assembly member comprises a recess of corresponding shape, or vice-versa.

According to a feature, said at least one first assembly member comprises a notch formed in the neck and said at least one second assembly member comprises a lug of corresponding shape, or vice-versa.

According to a feature, said at least one first assembly member comprises a rotational stop shaped to stop said at least one second assembly member coming to bear on the stop.

In particular the rotational stop makes it possible to stop the rotation of the lid around the neck when the lid passes from the opening position to the closing position.

According to a feature, said at least one second assembly member and/or said at least one first assembly member is elastic.

According to a feature, the lid comprises at said at least one second assembly member a cut-out increasing the elasticity of the second assembly member.

BRIEF DESCRIPTION OF DRAWINGS

Still other particularities and advantages of the invention will appear in the following description with reference to the accompanying drawings which are given by way of non-limiting examples:

FIG. 1 is a perspective view of a cosmetic product pot according to an embodiment of the invention;

FIG. 2 is an exploded view of FIG. 1;

DETAILED DESCRIPTION

FIGS. 1 and 2 show a pot 1 according to an embodiment.

In the example embodiment illustrated the pot 1 is a vessel configured for containing a product directly accessible by the user, and provided to be taken for example by finger or by means of a spatula. A pot according to the invention can nevertheless be any type of vessel or container. By way of non-limiting example, the pot may be a vessel provided with a pump or with a pipette enabling the product contained in the vessel to be taken.

The pot 1 comprises a base 2 and a lid 3 enabling the pot 1 to be opened or closed. In this example, the pot 1 also comprises a seal 4 disposed between the base 2 and the lid 3.

The pot shown in these Figures is a pot having a square contour. By "square contour" is meant a pot having a base having a substantially parallelepiped shape with a square bottom, which does not exclude pots having bulging contours or any other slight alteration to its general shape. Furthermore, the present description is made for a pot 1 with a square contour, but is valid mutatis mutandis for any pot whatever the outside general shape of its base.

In the present description, by transverse plane is meant a plane parallel to the bottom of the base of the pot, and by vertical plane is meant a plane at a right angle to the transverse plane.

The pot 1 is symmetrically formed here relative to a vertical plane.

Figure 3:
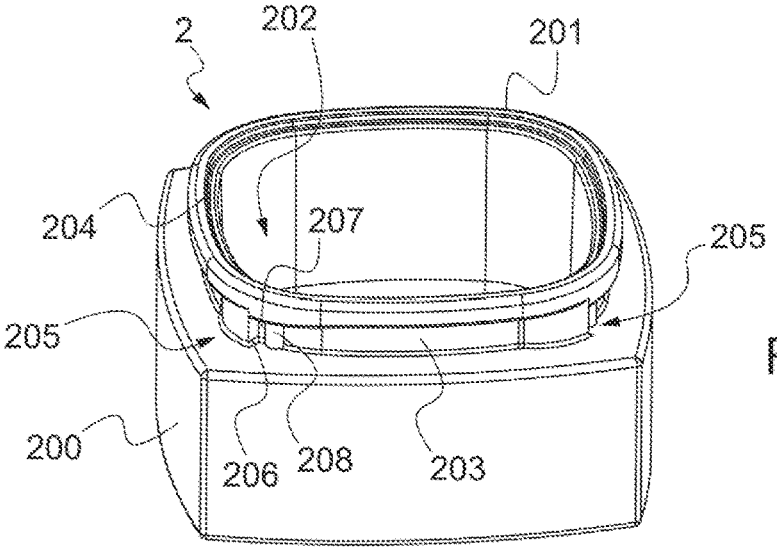
FIG. 3 is a perspective view of a base of the pot of FIG. 1 from a first viewing angle.
Figure 4:
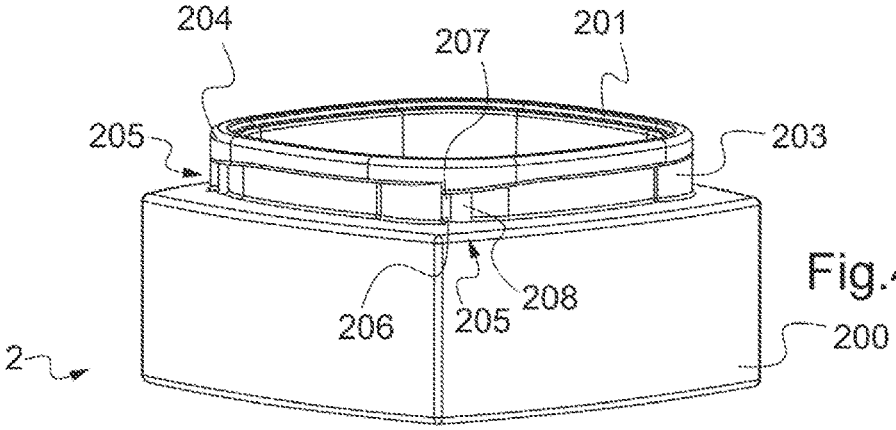
FIG. 4 is a perspective view of the base of the pot from a second viewing angle.

The base 2 is for example shown individually in FIGS. 3 and 4 from two different viewing angles. The base 2 comprises a container 200 and a neck 201 which surmounts the container 200. The neck 201 defines an opening 202 which enables access to a product contained in the container 200. The dimensions of the neck 201 and of the opening 202 are in the vicinity of the cross-section dimensions of the base 2. Whatever the case, in the example shown here, the opening 202 of the pot 1 is sufficiently wide to enable the passage of at least one finger of one hand, that is to say that it has, in cross section, a transverse dimension greater than or equal to approximately 25 millimeters.

The neck 201 comprises an outside wall surface 203, and a rim 204 formed in the outside wall surface 203. The rim 204 forms a bead on the perimeter of the neck 201.

The outside wall surface 203 is substantially convex here in the part located under the rim 204. This makes it possible to facilitate a rotational movement of the lid 3 on the neck 201.

Preferably, an upper part of the rim 204 is rounded or beveled, to create a ramp effect with the seal 4 when the seal 4 is moved vertically against the neck.

The neck 201 has a (transverse) cross-section that is non-circular. In this example embodiment, the neck 201 has a substantially square cross-section. The peek 21 here has a cross-section of substantially similar form to the contour of the base. More specifically, the neck 201 comprises four identical portions, that is to say of the same form and same dimensions, forming together the lateral faces of a parallelepiped the base of which is substantially square. The intersections between the portions have rounded corners. The rounded corners facilitate the rotation of the lid around the base.

Of course, the present description applies to other neck shapes. In particular, it applies to any pot having a neck of non-circular cross-section. By way of example, the neck may have a substantially polygonal or oval cross-section. In other words, the neck may have a prismatic form the base of which is a polygon or for instance a cylindrical form the base of which is non-circular, for example oval.

The neck 201 comprises at least one first assembly member 205. Said at least one first assembly member 205 is formed in the outside wall surface 203. Said at least one first assembly member 205 is formed here under the rim 204.

In the illustrated example, the neck 201 comprises four first assembly members 205. "First assembly member" is used to refer generally to part of the neck 201 configured to cooperate with a second assembly member carried by the lid 3. The cooperation between the first assembly member and the second assembly member provides or participates in the closing of the pot as is described below. The first assembly members 205 are advantageously formed at the location of the corners of the neck 201. This facilitates identifying their location.

Of course, the number and location of the first assembly members 205 may vary.

As the first assembly members 205 are all identical here, the description is made for one of them only.

The first assembly member 205 comprises a stop 206. The stop 206 is a rotational stop making it possible to stop the rotation of the lid 3 around the neck 201 when the lid 3 passes from an opening position to a closing position.

The stop 206 is formed for example here by a shoulder provided in the outside wall surface 203 of the neck 201. More specifically, a notch 207 is provided in the outside wall surface 203 such that the neck 201 then has a locally reduced thickness. A face of the neck 201 tangential to the notch 207 then forms the shoulder or stop 206.

The first assembly member 205 of the neck 201 here also comprises a projection 208. The projection 208 is in relief relative to the outside wall surface 203 of the neck 201. The projection 208 here has a semi-cylindrical shape. The projection 208 is tangential to the notch 207.

The base 2 is formed of any appropriate material, in particular glass or plastics material. It may be transparent or opaque. The base 2 may be provided to receive an added-on tub or refill which contains the cosmetic product.

Figure 5:
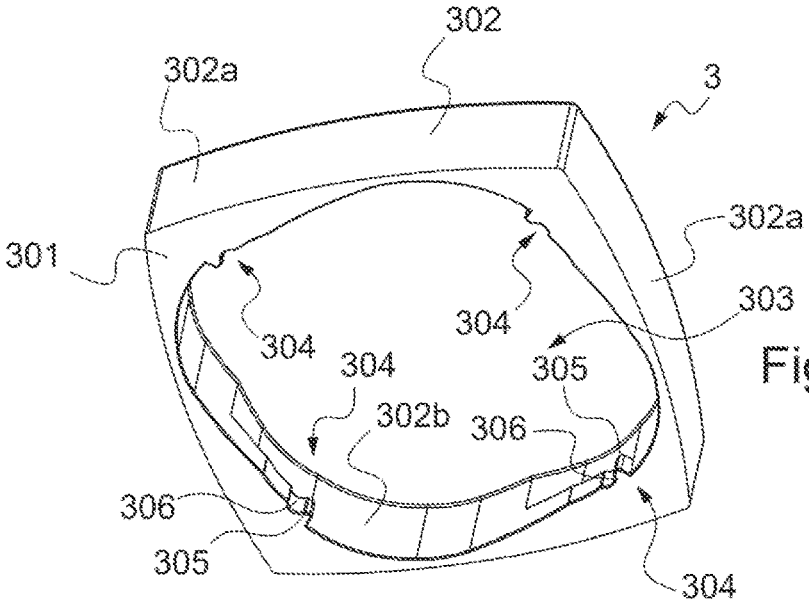
FIG. 5 is a perspective view of a lid of the pot of FIG. 1.
Figure 6:
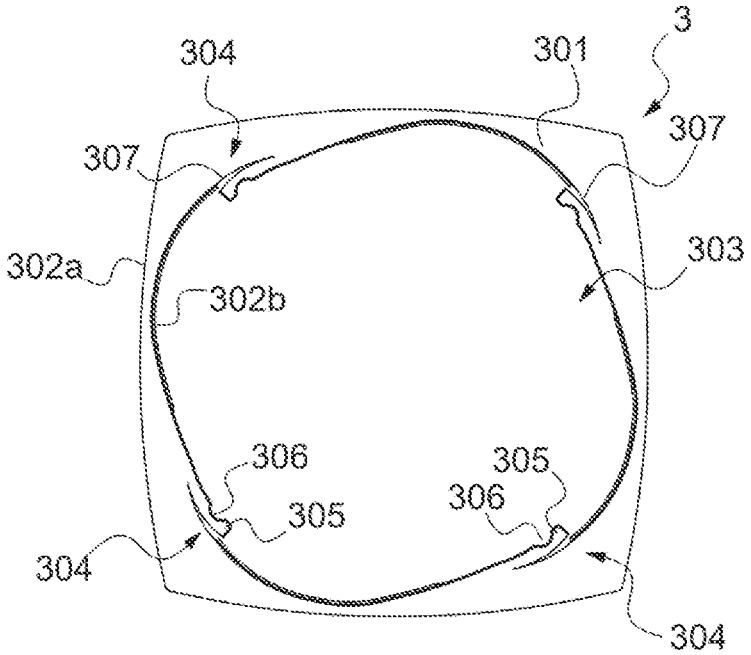
FIG. 6 is a view from below of the lid of FIG. 5.

The lid 3 is individually shown in FIGS. 5 and 6. The lid comprises an upper face 300, a lower wall surface 301, at the hack of the upper face 300, and a contour wall surface 302.

The 3 here has square contours, that is to say that the upper face 300 has a square shape. Advantageously, the lid 3 has substantially (or exactly) the same contour dimensions and shape as the base 2.

The upper face 300 here constitutes an outside face, provided for example to be visible to a user when the pot 1 is closed with the lid 3.

The lid 3 comprises a cavity 303 provided in the lower wall surface 301. The cavity 303 forms an inside part of the lid 3 not visible to the user when the lid 3 closes the opening 202.

The contour wall surface 302 comprises an outside contour surface 302*a* and an inside contour surface 302*b*.

The outside contour surface 302*a* extends at the periphery of the upper face 300. In other words, the outside contour surface 302*a* is tangential to an edge of the upper face 300. The outside contour surface 302*a* is visible to the user when the lid 3 closes the opening 202.

The inside contour surface 302*b* peripherally delimits the cavity 303. The inside contour surface 302*b* extends within the inside part of the lid 3. The inside contour surface 302*b* is thus not visible to the user when the lid 3 closes the opening 202.

The inside contour surface 302*b* has rounded corners of shape complementary to the rounded corners of the neck 201.

The lid 3 comprises at least one second assembly member 304 of shape complementary to the first assembly member 205 of the neck 201. In the example shown, the lid 3 comprises four second assembly members 304. Each second assembly member 304 of the lid 3 has a corresponding first assembly member 205 of the neck 201 with which it is configured to cooperate.

In the example shown, the four second assembly members 304 are formed at the location of the rounded corners of the contour wall surface 302.

Of course, the number and location of the second assembly members may vary.

As the second assembly members 304 are all identical here, the description is given solely for one of them but of course applies to all of the others.

The second assembly member 304 is formed in the contour wall surface 302. The second assembly member 304 extends in the inside part of the lid 3 so as not to be visible to the user when the lid closes the opening 202. This makes it possible to improve the aesthetics of the pot 1.

The second assembly member 304 here comprises a protuberance or lug 305, and a recess 306. The lug 305 and the recess 306 are adjacent to each other. The lug 305 has a shape complementary to the notch 207 formed in the neck 201. The recess 306 also has a complementary shape to the projection 208. The lug 305 of the second assembly member 304 is configured to insert into the notch 207 of the first assembly member 205 between the stop 206 and the projection 208. The recess 306 of the second assembly member 304 is configured to accommodate the projection 208 of the first assembly member 205.

The second assembly member 304 here has a height at most equal to the height of the first assembly member 205 of the neck 201. Preferably, the second assembly member 304 has a height less than or perceptibly less than the height of the first assembly member 205 of the neck 201.

By height is meant the vertical dimension. The height of the neck 201 corresponds to the sum of the height of the rim 204 and of the height of the first assembly member 205 taken in a same vertical plane.

In the example shown, the height of each of the rim and of the first assembly member is not the same at every location. The neck 201 has at least one slope or ramp formed at the frontier between the rim 204 and the first assembly member 205. A slope is formed here in each of the portions of the neck 201.

The second assembly member 304 is advantageously formed from elastic material. For example the flexibility of the material constituting the lid 3 (generally made from a plastics material) may be taken advantage of by the second assembly member. This enables simple fitting together between the first assembly member 205 and the second assembly member 304 through insertion.

In the example embodiment shown in FIG. 6, the second assembly member comprises a cleft 307 formed in the contour wall surface 302. Said cleft confers more flexibility to the second assembly member 304 and thus greater ease in fitting together with the first assembly member 205 through insertion.

According to an embodiment, the lid 3 may be entirely made from an elastic material. The lid 3 may be produced by molding or injection so as to give it the desired shape.

In general terms, at least one of the first assembly member and second assembly member has flexibility and elasticity enabling said assembly members to be fitted together through insertion.

The inside contour surface 302*b* has a shape and dimensions enabling it to surround the neck 201 so as to close the opening 202. In other words, the cross-section of the cavity 303 is at least as great as the cross-section of the neck 201 such that the lid 3 can surround and turn around the neck 201 of the base 2.

The lid 3 is configured to take an opening position and a closing position in which the lid 3 closes the opening 202. When the lid 3 is in the opening and closing positions, the contour wall surface 302, and in particular the inside contour surface 302*b*, surrounds the neck 201.

The opening position of the lid 3 corresponds to the position in which the second assembly member 304 is clear of the first assembly member 205 and of the rim 204 of the neck 201. In this position, the lid can freely turn and be extracted vertically relative to the neck 201. The closing position of the lid 3 corresponds to the position in which the second assembly member 304 is disposed under the rim 204 of the neck 201. In this position, the rotation of the lid is stopped by the cooperation of the assembly members (except if a sufficient force is applied to the lid to overcome the resistance created by the fitting together of the assembly members through insertion), and the vertical extraction of the lid 3 relative to the neck 201 is prevented by the interaction between the first assembly members and the bead 204 detailed below.

Figure 7:
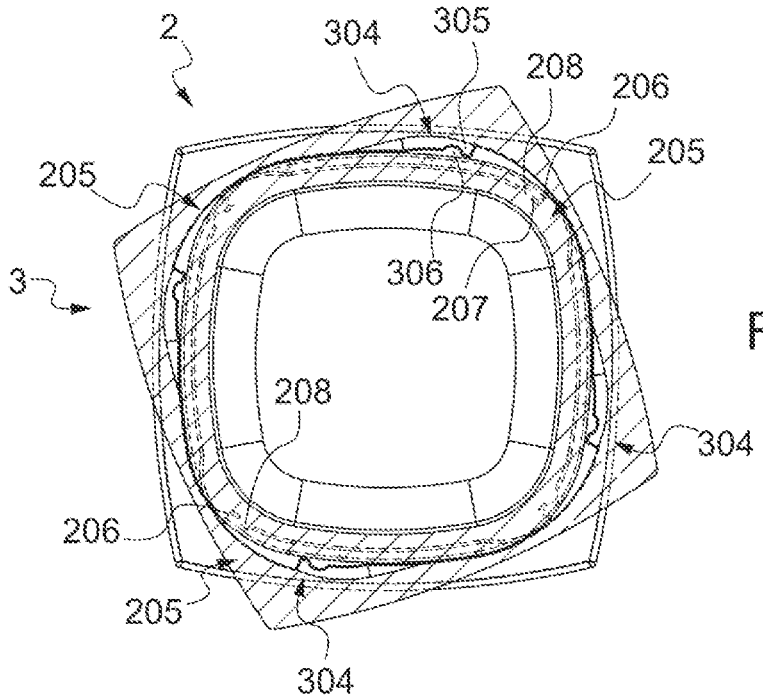
FIG. 7 is a cross-section view on a transverse plane of the pot of FIG. 1 in which the lid is in an opening position.
Figure 8:
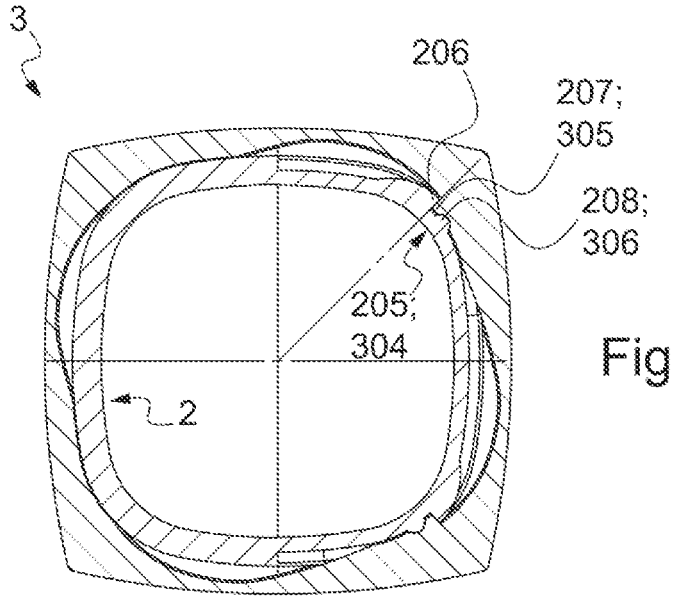
FIG. 8 is a cross-section view on said transverse plane of the pot of FIG. 1 in which the lid is in a closing position.
Figure 9:
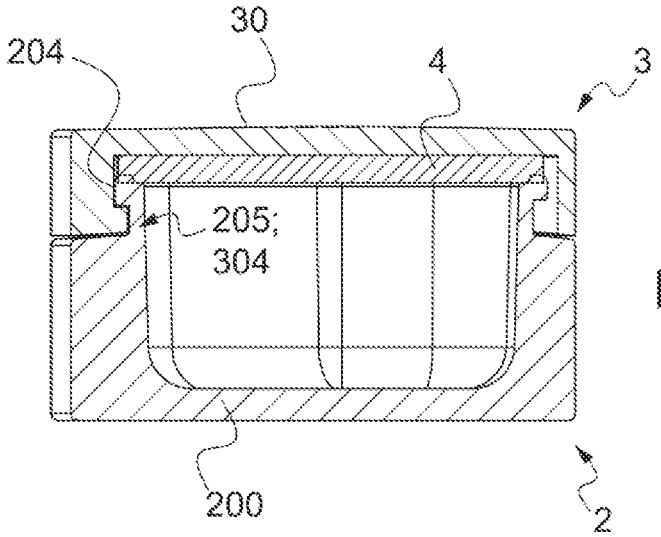
FIG. 9 is a cross-section view on a vertical plane of the pot of FIG. 1 in the closing position.

FIG. 7 shows the lid 3 positioned around the neck 201, in the opening position. FIGS. 8 and 9 show the lid positioned around the neck 201, in the closing position.

Advantageously, the cross-section of the cavity 303 corresponds to the superposition one of the cross-section of the neck 201 in a first position of the cross-section of the neck 201 in a second position rotated through a predefined angle relative to the first position. In other words, the cross-section of the cavity 303 corresponds to the superposition of the cross-section of the neck 201 and of its image obtained by the rotation around its center (or barycenter) of said cross-section through a predefined angle.

The predefined angle constitutes the angle swept through by the lid 3 when it passes from an extreme opening position to the closing position, or vice-versa.

The predefined angle may be less than 45°. In a preferred embodiment, the predefined angle is of the order of 22°.

The cavity 303 is thus formed when the lid 3 comprises the same number of second assembly members 304 as the number of first assembly members 205 of the neck 201.

In another embodiment, the lid 3 may comprise a number of second assembly members 304 less than the number of first assembly members 205 of the neck 201. In the example of the neck 201 of substantially square cross-section and having four first assembly members 205, the lid 3 may comprise a single, two or three second assembly members 304.

Of course, the converse can perfectly well be envisioned. The lid 3 may comprise a number of second assembly members 304 greater than the number of first assembly members 205 of the neck 201.

Whatever the case, the cavity 303 has a cross-section enabling the lid 3 to surround the neck 201 when the lid 3 closes the opening 202, in particular in opening and closing position. Furthermore, the cavity 303 has a cross-section such that the lid 3 can be extracted vertically from the neck 201 and turn around the neck 201 when the lid 3 is in opening position, and a resistance to the rotation of the lid 3 relative to the neck 201 is created and the vertical extraction of the lid 3 relative to the neck 201 is prevented when the lid 3 is in the closing position.

When a user wishes to close the pot 1, he positions the lid 3 in opening position, as in FIG. 7. In this position the lid 3 is turned through the predefined angle relative to the neck 201. The rounded corners of the lid 3 here face opposite the rounded corners of the neck 201.

In order to close the pot 1, the user turns the lid 3, for example clockwise. The lid 3 turns around the neck 201 until the first assembly member 205 of the neck 201 and the second assembly member 304 of the lid 3 cooperate together. In other words, the lid 3 turns around the neck 201 until the second assembly member 304 comes to bear against the stop 206 of the neck 201. The stop 206 thus forms a rotational stop for the lid 3. In the described example, when the lid 3 is in the closing position, the lug 305 is inserted into the notch 207 of the neck 201, and the projection 208 is inserted into the recess 305. In this position, the second assembly member 304 extends under the rim 204. The lid. 3 is then stopped vertically by the bead 204. In other words, the lid 3 cannot be extracted vertically relative to the neck 201.

In order to open the pot 1, the user turns the lid 3 in the opposite direction to the direction for closing, for example anticlockwise. The user overcomes the resistance created by the cooperation between the first assembly members and the second assembly members. The second assembly member 304 of the lid is clear of the first assembly member 204 of the neck 304. The second assembly member 304 of the lid 3 is then clear of the stop 206 of the neck 201. The lug 305 is clear of the notch 207. The projection 208 is also clear of the recess 205. The free rotation of the lid 3 relative to the base 2 is then again possible. The second assembly member 304 of the lid 3 is also clear of the rim 204 of the neck 201. The lid 3 can then be vertically extracted relative to the neck 201 since it is no longer stopped by the bead 204.

Naturally, the present invention is not limited to the embodiments described and illustrated.

The invention makes it possible to keep a form of manipulation for screwing onto a neck which would not be expected to enable this on account of its geometry such as a square, another form of polygon, and more generally numerous forms that are not circular.

Such a lid 3 is easily adaptable to any base 2, configured to contain a cosmetic product comprising a neck 201 having at least one first assembly member 205 and a rim 204. Only the lid 3 is modified to enable the opening and the closing of the pot by a simple and intuitive form of manipulation.

The invention claimed is:

1. Cosmetic product pot comprising:

a base;

a neck having a non-circular cross section and surmounting the base, the neck defining an opening; and a lid configured to close the opening;

the neck comprising a rim forming a bead over a perimeter of the neck;

the neck comprising at least one first assembly member formed in an outside wall surface of the neck under the rim;

the lid comprising a contour wall surface configured to surround the neck when the lid is positioned on the neck in an opening position or a closing position in which positions the lid closes the opening;

the lid comprising at least one second assembly member formed in the contour wall surface and of complementary shape to the at least one first assembly member, so as to enable fitting together of the at least one first assembly member with the at least one second assembly member through insertion;

the lid being configured such that:

when the lid is in the closing position:

the at least one second assembly member of the lid is disposed under the rim of the neck, preventing a vertical extraction of the lid in relation to the neck; and the at least one second assembly member and the at least one first assembly member are fitted together by insertion so as to create resistance to relative rotation of the lid and the neck; and when the lid is in the opening position, the at least one second assembly member is clear of the at least one first assembly member and of the rim of the neck, so as to enable the vertical extraction of the lid in relation to the neck;

the lid being configured to pass from the opening position to the closing position and vice-versa by rotation of the lid around the neck; and the contour wall surface of the lid delimiting a cavity provided in the lid the cross section of which corresponds to the superposition of the cross section of the neck in a first position and of the cross section of the neck in a second position rotated through a predefined angle in relation to the first position.

2. Pot according to claim 1, wherein:

the predefined angle is less than 45° and strictly greater than 0°.

3. Pot according to claim 1, wherein:

the predefined angle is equal to 22°.

4. Pot according to claim 1, wherein:

the neck has a prismatic cross section having a base of polygonal shape or of polygonal shape having rounded corners and/or sides.

5. Pot according to claim 4, wherein:

the neck has a square cross section, or a square cross section with rounded corners, and/or sides.

6. Pot according to claim 4, wherein:

the at least one first assembly member is formed at the location of one or more corners of the cross section of the neck.

7. Pot according to claim 4, wherein:

the neck comprises a number of first assembly members equal to the number of sides of the polygon.

8. Pot according to claim 1, wherein:

the neck has an oval cross section.

9. Pot according to claim 1, wherein:

the lid comprises a number of second assembly members equal to the number of first assembly members of the neck.

10. Pot according to claim 1, wherein:

the at least one first assembly member comprises a projection in relief of the outside wall surface of the neck and the at least one second assembly member comprises a recess of corresponding shape, or vice-versa.

11. Pot according to claim 1, wherein:

the at least one first assembly member comprises a notch formed in the neck and the at least one second assembly member comprises a lug of corresponding shape, or vice-versa.

12. Pot according to claim 1, wherein:

the at least one first assembly member comprises a rotational stop shaped to stop the at least one second assembly member coming to bear on the stop.

13. Pot according to claim 1, wherein:

the at least one second assembly member and/or the at least one first assembly member is elastic.

14. Pot according to claim 13, wherein:

the lid comprises at the at least one second assembly member a cut-out increasing the elasticity of the second assembly member.

15. Cosmetic product pot comprising:

a base;

a neck having a non-circular prismatic cross section and having a base of polygonal shape having rounded corners and/or sides surmounting the base, the neck defining an opening; and a lid configured to close the opening;

the neck comprising a rim forming a bead over a perimeter of the neck;

the neck comprising at least one first assembly member formed in an outside wall surface of the neck under the rim;

the lid comprising a contour wall surface configured to surround the neck when the lid is positioned on the neck in an opening position or a closing position in which positions the lid closes the opening;

the lid comprising at least one second assembly member formed in the contour wall surface and of complementary shape to the at least one first assembly member, so as to enable fitting together of the at least one first assembly member with the at least one second assembly member through insertion;

the lid being configured such that:

when the lid is in the closing position:

the at least one second assembly member of the lid is disposed under the rim of the neck, preventing a vertical extraction of the lid in relation to the neck; and the at least one second assembly member and the at least one first assembly member are fitted together by insertion so as to create resistance to relative rotation of the lid and the neck; and when the lid is in the opening position, the at least one second assembly member is clear of the at least one first assembly member and of the rim of the neck, so as to enable the vertical extraction of the lid in relation to the neck; and the lid being configured to pass from the opening position to the closing position and vice-versa by rotation of the lid around the neck.

16. Cosmetic product pot comprising:

a base;

a neck having a non-circular cross section and surmounting the base, the neck defining an opening; and a lid configured to close the opening;

the neck comprising a rim forming a bead over a perimeter of the neck;

the neck comprising at least one first assembly member formed in an outside wall surface of the neck under the rim;

the lid comprising a contour wall surface configured to surround the neck when the lid is positioned on the neck in an opening position or a closing position in which positions the lid closes the opening;

the lid comprising at least one second assembly member formed in the contour wall surface and of complementary shape to the at least one first assembly member, so as to enable fitting together of the at least one first assembly member with the at least one second assembly member through insertion;

the at least one first assembly member comprising a notch formed in the neck and the at least one second assembly member comprising a lug of corresponding shape, or vice-versa;

the lid being configured such that:

when the lid is in the closing position:

the at least one second assembly member of the lid is disposed under the rim of the neck, preventing a vertical extraction of the lid in relation to the neck; and the at least one second assembly member and the at least one first assembly member are fitted together by insertion so as to create resistance to relative rotation of the lid and the neck; and when the lid is in the opening position, the at least one second assembly member is clear of the at least one first assembly member and of the rim of the neck, so as to enable the vertical extraction of the lid in relation to the neck; and the lid being configured to pass from the opening position to the closing position and vice-versa by rotation of the lid around the neck.

* * * * *